United States Patent [19]

McAllister

[11] Patent Number: 5,038,573

[45] Date of Patent: Aug. 13, 1991

[54] FORMATION OF ICE CUBES WITH DISTINCTIVE MARKINGS

[75] Inventor: Larry N. McAllister, Dover, Del.

[73] Assignee: Crystal Tips, Inc., Smyrna, Del.

[21] Appl. No.: 491,488

[22] Filed: Mar. 9, 1990

[51] Int. Cl.[5] ..... F25C 1/12

[52] U.S. Cl. ..... 62/74; 62/347

[58] Field of Search ..... 62/347, 74, 1, 348, 62/352

[56] References Cited

U.S. PATENT DOCUMENTS

| | | | |
|---|---|---|---|
| 2,514,942 | 7/1950 | Eaton | 62/1 X |
| 3,220,214 | 11/1965 | Cornelius | 62/347 |
| 3,433,030 | 3/1969 | Jacobs | 62/347 X |
| 4,459,824 | 7/1984 | Krueger | 62/347 |
| 4,685,304 | 8/1987 | Essig | 62/1 X |

FOREIGN PATENT DOCUMENTS

| | | | |
|---|---|---|---|
| 1156092 | 10/1963 | Fed. Rep. of Germany | 62/347 |

*Primary Examiner*—William E. Tapolcai

*Attorney, Agent, or Firm*—Connolly and Hutz

[57] ABSTRACT

An ice cube making machine has a plate with a plurality of cube forming locations on an outside surface of the plate. Each location has an outside surface generally flush with the outside surface of the plate and an inside surface exposed to the affects of refrigerant. The improvement comprises raised indicia on the outside surface of at least some of the cube forming locations for impressing distinctive markings into the ice cubes during formation thereof at these locations.

2 Claims, 2 Drawing Sheets

FORMATION OF ICE CUBES WITH DISTINCTIVE MARKINGS

BACKGROUND OF THE INVENTION

The present invention relates to the production of ice cubes, and more particularly to methods and apparatus for producing ice cubes having distinctive markings therein.

Numerous methods and machines have been proposed for producing ice cubes in a variety of shapes and sizes. However, other than the overall shape of the ultimately produced ice cubes, the heretofore produced cubes lack any distinctive markings which might serve to distinguish one cube from another.

One particular machine for producing ice cubes comprises the plate of an evaporator having a plurality of spaced apart ice cube forming buttons fitted into the surface of the plate. The outside of each button is generally circular in configuration and flus with the surface of the plate. Each button is exposed to the affects of refrigeration on the inner surface thereof. As liquid water flows over the outside surface of the plate, the water freezes and adheres to the buttons until a build-up of ice has occurred. The ice is thickest at the center of the button and diminishes in thickness to a generally circular periphery at the plate thereby forming a lenticular shaped ice cube. During harvest by hot gas recycle or other means, the formed lenticular ice cubes release from the buttons of the plate and the process is then repeated. Other than overall shape these cubes have no distinctive characteristics.

Another machine includes a typical slab evaporator that freezes small square or rectangular cubes, commonly called "diced ice". A raised grid on the evaporator aids in the production of the square or rectangular shaped cubes.

Other ice making machines utilize different structural arrangements in the production of ice cubes having a variety of shapes and sizes. However, other than overall shape, the produced cubes lack any distictive markings which might serve to distinguish one cube from another.

SUMMARY OF THE INVENTION

Accordingly, it is an object of the present invention to provide apparatus and production methods for producing ice cubes having visual indicia therein which distinguish the formed cubes from other similarly shaped cubes.

In accordance with the present invention an ice cube making machine has a plate with a plurality of cube forming locations on an outside surface of the plate. Each of these locations has an outside surface generally flush with the outside surface of the plate and an inside surface exposed to the affects of refrigerant. The improvement comprises raised indicia on the outside surface of at least some of the cube forming locations for impressing distinctive markings into the ice during cube formation at these locations.

An ice cube forming button may be provided at each cube forming location on the plate. Each button has an outside surface generally flush with the outside surface of the plate and an inside surface exposed to the affects of refrigerant. Each button has raised indicia on the outside surface thereof for impressing distinctive markings into the ice during cube formation at and on the buttons.

In its simplest form, one embodiment of the present invention comprises an ice cube forming button having a generally flat face with raised indicia thereon for impressing distinctive markings into the ice during cube formation on the button.

BRIEF DESCRIPTION OF THE DRAWING

Novel features and advantages of the present invention in addition to those mentioned above will become apparent to persons of ordinary skill in the art from a reading of the following detailed description in conjunction with the accompanying drawing wherein similar reference characters refer to similar parts and in which.

DETAILED DESCRIPTION OF THE INVENTION

Figure 1:
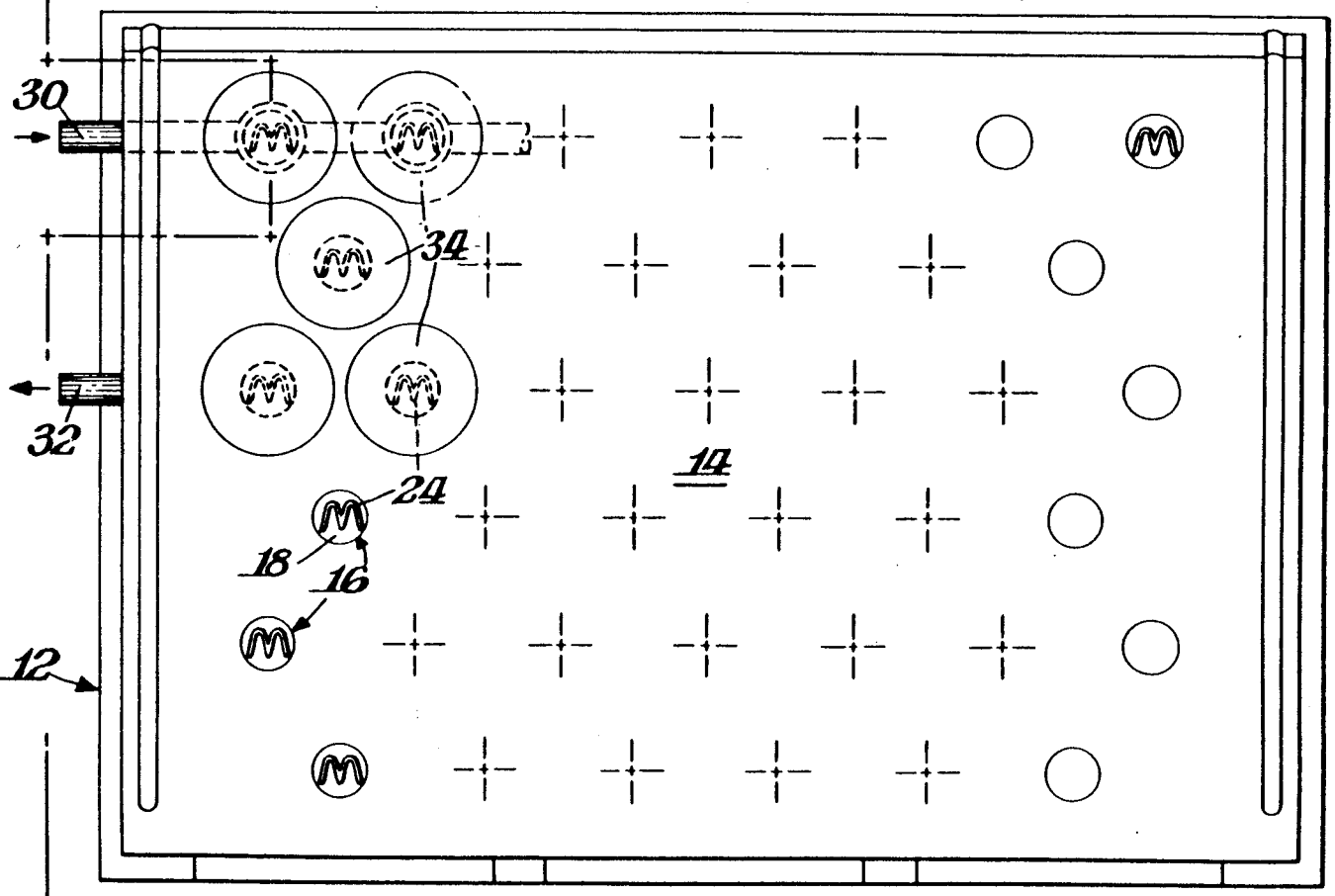
FIG. 1 is a side elevational view of an evaporator plate for producing ice cubes with visual indicia, according to the present invention.
Figure 2:
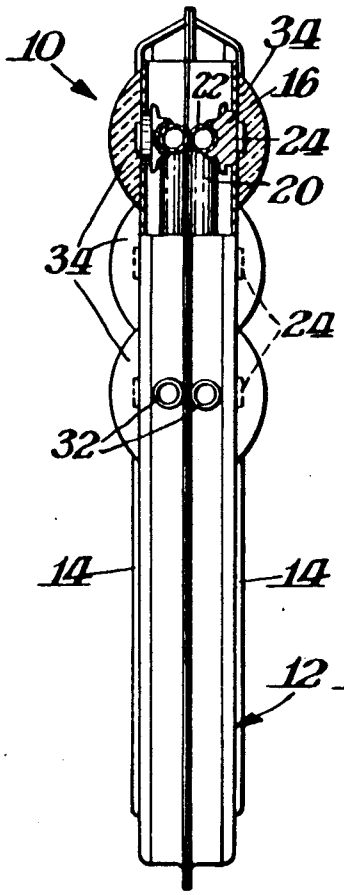
FIG. 2 is an end elevational and cross-sectional view taken along line 2—2 of FIG. 1.
Figure 3:
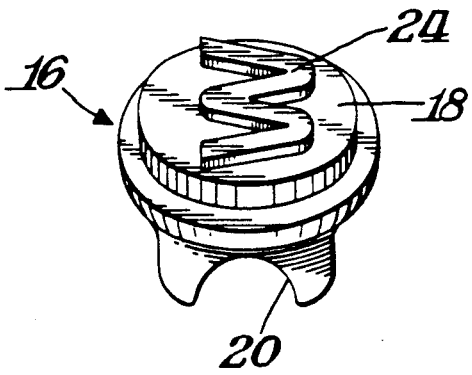
FIG. 3 is a pictorial view of an ice cube forming button, according to the present invention.

Referring in more particularly to the drawing, FIGS. 1 and 2 illustrate an ice cube making machine 10 and specifically the evaporator portion 12 of the machine. Evaporator 12 is vertically oriented and generally includes a freezing plate 14 on each side thereof over which water flows during the ice forming process, as explained more fully below.

Each freezing plate 14 of evaporator 12 includes a plurality of spaced apart cube forming buttons 16 exposed on the outside surface of the plate. Buttons 16 are fitted into accommodating openings in plate 14 and then swagged into place for permanent attachment to the plate. Each of the buttons 16 has an outside surface 18 which is generally flush with the outside surface of the freezing plate 14. Each button also includes a configured inside surface 20 which is exposed to the affects of refrigerant. This is accomplished by engagement between surface 20 of each button and copper tubing 22 through which the refrigerant flows. Each of the buttons 16 is physically secured to copper tubing 22 in good heat transfer relationship by soldering or other means known in the art.

Raised indicia 24 is provided on the outside surface 18 of each of the cube forming buttons 16. As explained more fully below, the raised indicia produces visual distinctive markings in the ice during formation thereof at and on the ice forming buttons. Such indicia may be approximately ⅛ inch in height.

During ice cube formation refrigerant flows through copper tubing 22 starting at inlet 30 and exiting at outlet 32. Tubing 22 is arranged in serpentine fashion and each of the buttons 16 is attached to the tubing and thereby exposed to the refrigerant flowing through the tubing. Liquid water flowing over the outside surfaces 14 of evaporator 12 then adheres to the outside surface 18 of each of the cube forming buttons 16 until a sufficient thickness of ice forms at each button. The combination of the flowing water and the chilled buttons produces lenticular shaped ice cubes 34 at each ice forming button 16. The ice is thickest at the center of cube 34 and diminishes in thickness to a circular periphery at the surface of the freezing plate.

The raised indicia 24 on each of the buttons 16 produces a visual impression 36 in each lenticular shaped ice cube 34.

During of the ice cubes 34, the flow of water over the freezing plates 14 of evaporator 12 is terminated. Harvest may then be accomplished by hot gas recycle through tubing 22 or by other means. Such hot gas recycle or other means functions to slightly melt the formed ice cubes 34 at the interface of each cube and the outside surface 18 of the forming button 16. This procedure also operates to release the ice cubes 34 from those portions of the freezing plates immediately surrounding the buttons. The lenticular shaped ice cubes 34 then fall by gravity to a storage bin from which they are collected. The process is repeated.

Figure 4:
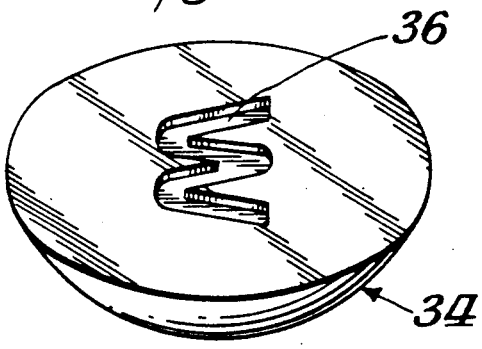
FIG. 4 is a pictorial view of a lenticular shaped ice cube produced by the cube forming buttons shown in FIGS. 1 through 3.

As shown best in FIG. 4, each of the formed ice cubes 34 has distinctive markings 36 therein which remain readily visible until the cube melts.

It is within the scope of the present invention that the raised indicia 24 on each of the cube forming buttons 16 may take the form of any desired letter or lettering, logos, symbols, and the like. Any form of such raised indicia on the outside surface of the buttons produces a lasting visual impression of distinctive markings in the formed ice cubes.

What is claimed is:

1. In an ice cube making machine having a plate with a plurality of cube forming locations on an outside surface of the plate, each location having an outside surface generally flush with the outside surface of the plate and an inside surface exposed to the affects of refrigerant, the improvement comprising raised indicia on the outside surface of at least some of the cube forming locations for impressing distinctive markings into the ice during formation thereof at these locations, an ice cube forming button provided at each cube forming location on the plate, each button having an outside surface generally flush with the outside surface of the plate and an inside surface exposed to the effects of refrigerant, and each button having raised indicia on the outside surface thereof for impressing distinctive markings into the ice during formation thereof at and one the buttons.

2. A method of producing ice cubes having distinctive markings therein including the steps of providing a vertically oriented plate having a plurality of cube forming locations on an outside surface thereof, providing the plate with a plurality of spaced a part ice cube forming buttons at the cube forming locations on the outside surface of the plate, each button having raised indicia thereon, chilling each of the buttons while flowing over over the vertically oriented plate and the buttons therein to produce ice formations at the buttons, continuing the chilling of the buttons and the flowing of water until a desired thickness of ice is formed at each button to thereby produce ice cubes having distinctive markings therein, and releasing the cubes from the plate.

* * * * *

UNITED STATES PATENT AND TRADEMARK OFFICE

CERTIFICATE OF CORRECTION

PATENT NO. : 5,038,573

DATED : August 13, 1991

INVENTOR(S) : LARRY N. McALLISTER

It is certified that error appears in the above-identified patent and that said Letters Patent is hereby corrected as shown below:

Column 1, line 21, change "flus" to -- flush --.

Column 4, line 11, change "effects" to -- affects --.

Column 4, line 14, change "one" to -- on --.

Column 4, line 24, change "over" (first occurrence) to -- water --.

Signed and Sealed this

Nineteenth Day of January, 1993

*Attest:*

*Attesting Officer*

DOUGLAS B. COMER

*Acting Commissioner of Patents and Trademarks*